United States Patent [19]

Lobdell

[11] Patent Number: 4,537,282

[45] Date of Patent: Aug. 27, 1985

[54] WORK HOLDING STACKABLE STEP STOOL

[76] Inventor: George H. Lobdell, Rte. 4 - Box 60, Canton, N.Y. 13617

[21] Appl. No.: 593,841

[22] Filed: Mar. 27, 1984

[51] Int. Cl.[3] ..... E04G 1/28

[52] U.S. Cl. ..... 182/46; 182/117; 182/129; 182/178

[58] Field of Search ..... 182/181–186, 182/224, 225, 129, 46, 178; 269/307, 902

[56] References Cited

U.S. PATENT DOCUMENTS

| | | | |
|---|---|---|---|
| D. 138,620 | 8/1944 | Morley | D15/8 |
| D. 242,423 | 11/1976 | Culligan | D7/191 |
| D. 265,026 | 6/1982 | Macho et al. | D6/1 |
| 394,026 | 12/1888 | Smith | 182/181 |
| 2,452,426 | 10/1948 | Blaske | 269/307 |
| 2,592,912 | 4/1952 | Knipper | 182/33 |
| 2,636,526 | 4/1953 | Madden | 182/129 |
| 2,698,771 | 1/1955 | O'Rourk | 182/181 |
| 2,911,265 | 11/1959 | Hannah | 182/181 |
| 3,339,920 | 9/1967 | Moritz | 182/181 |
| 3,824,744 | 7/1974 | Petrand | 269/902 |
| 3,862,671 | 1/1975 | Parr | 182/132 |
| 3,881,571 | 5/1975 | Moulton | 182/178 |
| 3,907,068 | 9/1975 | Ulerich | 182/194 |
| 3,984,144 | 10/1976 | Steinbrecher | 297/174 |
| 3,999,628 | 12/1976 | Parson | 182/129 |
| 4,105,091 | 8/1978 | Mahan | 182/181 |

*Primary Examiner*—Reinaldo P. Machado

*Attorney, Agent, or Firm*—Shoemaker and Mattare, Ltd.

[57] ABSTRACT

A work supporting and holding stackable step stool is formed of plastic material, and includes a plurality of vertical and horizontal apertures provided in the step stool body sides for supporting and holding lumber material therewith for providing low and medium height scaffolding, as well as for securely retaining lumber material to be cut, drilled, sanded and the like. Further holes are provided in each step stool for securely holding tubing or pipe to be worked upon. Planar support surfaces provide a user with both steps as well as work supporting surfaces and each step is provided with a shallow V-shaped recess for holding material of round configuration during work thereupon. A raised lip on the upper step on one edge thereof provided with measuring indicia can be used for measuring material to be cut, drilled, and the like. Electric power outlet receptacle structure, a storage box, a pencil sharpener and nail suspension apertures are additional features of the present step stool arrangement.

21 Claims, 5 Drawing Figures

TD

WORK HOLDING STACKABLE STEP STOOL

BACKGROUND OF THE INVENTION

1. Field of the Invention

The present invention relates, in general, to step stools which can be stacked one upon the other, and specifically to step stools having multi-purpose uses.

2. Description of the Prior Art

A number of known prior art devices are available which can be stacked, and also can be used for supporting scaffolding and the like, and/or use for other multi-purpose uses. However, known prior art type devices are rather complicated, fairly expensive and/or do not provide for the great number of work supporting and holding uses of the present invention.

Some prior art devices which may be pertinent to this invention are as follows:

E. J. Knipper U.S. Pat. No. 2,592,912—4/15/52
B. Parr U.S. Pat. No. 3,862,671—1/28/75
W. T. Ulerich U.S. Pat. No. 3,907,068—9/23/75
D. C. Steinbrecher U.S. Pat. No. 3,984,144—10/5/76
C. E. Morley U.S. Pat. No. D. 138,620—8/29/44
R. L. Culligan U.S. Pat. No. D. 242,423—11/23/76
J. M. Macho, et al. U.S. Pat. No. D. 265,026—6/22/82

None of these prior art devices offers the new and unique advantages of the present invention.

For example, the patent to Knipper, U.S. Pat. No. 2,592,912, discloses a combination foot stool, ladder, seat and storage chest. While this device does provide a number of multi-purpose uses, it is not designed to support low or medium height scaffolding, nor is it adapted for use in holding material to be worked upon in a secure and positive manner.

The patent to Parr, U.S. Pat. No. 3,862,671, shows a multiple step structure having a plurality of holes therein for making the device lightweight. However, these holes are not arranged for holding or securely retaining pipe or lumber type material for work thereupon. Such work holding and supporting features of the present invention are very important.

The patent to Ulerich, U.S. Pat. No. 3,907,068, shows a ladder block having a plurality of steps at different heights which can be used as a step ladder for reaching different heights depending on the size of the person using same. A pair of such blocks also can be used to support low or medium height scaffolding, i.e., boards therebetween for permitting a user thereof to work at different heights.

The patent to Steinbrecher, U.S. Pat. No. 3,984,144, shows a stepped desk cabinet for use by women and children. A horizontal flat desk top and a horizontal seat located therebelow and to the side thereof are supported by two step sides. A removable panel as a continuation of the seat serves as the top of the storage cabinet mounted by the removable panel and seat, the two sides and a back panel covering the lower half of the back of the cabinet. While this device can be used as an adult's portable step or table, as a storage cabinet or as a child's toy, it fails to teach the important multi-level supporting and holding structure of the present invention.

The design patents to Morley, Culligan and Macho, et al. show various designs for step stools, but also fail to disclose or teach the many important features of the present invention.

SUMMARY OF THE INVENTION

An object of the present invention is to provide an easily stackable step stool having a foot at each corner thereof with the area of the sides between the respective feet being raised so that the device may be used on a floor having various piping, wires and other clutter and debris thereon.

A further object of the present invention is to provide a work holding stackable step stool having a plurality of different apertures therein which may be utilized for supporting the ends of boards between a pair of the stools to provide low and medium height support scaffolding.

Another object of the present invention is to provide a work holding stackable step stool having a holding opening thereon of 1" and 2" heights for retaining boards so they will not slide while they are being worked upon.

A further object of the present invention is to provide a multi-purpose step stool having a multitude of holes on the sides and ends thereof ranging in size from ½" to 3½" so that a plumber can slide tubing and pipes of corresponding sizes through one side of the device to the other, and the device will function to securely hold and retain the pipe while being worked upon. The pipe may be cut, filed, bent, sawed and drilled while being thus held.

A further object of the present invention is to provide a device having a retaining lip together with measuring indicia thereon for accurately gauging and measuring materials to be worked upon, either pipe, tubing or lumber material.

Additional objects of the present invention are the provision of multiple small holes in the stool for insertion of common nails therein for use in hanging for storage, an optional electrical panel for providing convenient electric power outlets for energizing drills, saws and various tools being used with the device, a pencil sharpener for maintaining a carpenter's pencil in fine point condition, as well as a storage box receptacle for convenience of a user.

Another still further object of the present invention is to provide V-shaped shallow grooves in the top of each of two steps of a stackable step stool for the purpose of stabilizing various sized pipe while being worked upon.

The present invention offers a number of new and novel features in a work holding stackable step stool. The step stool has a body comprising four sides, with the corner of adjacent sides having extended leg portions for supporting the step stool above a cluttered floor or other work surface. Two steps are provided on the upper portion of the step stool body. Each step is provided with a slip resistant high friction top surface thereon, and also with a traversely extending shallow V-shaped recess for stabilizing and holding various sizes of pipes to be worked upon.

Further important features of the present invention include a plurality of openings in the sides and ends of the step stool body for reception of lumber material, i.e., two-by-fours, two-by-sixes, two-by-eights, two-by-twelves, as well as boards of thinner material, such as 1" or less. These lumber supporting apertures are arranged to complement each other and to provide the maximum in utility for a user of the step stool. Also, holes are provided in the sides and upper end portions of the stool for reception of tubing or piping of sizes ranging from ½" to 3½". Pipe or tubing thus can be securely held and retained by the device while a plumber or other craftsman works upon same.

In addition to the work holding and supporting features of the present invention, additional features include small apertures for receiving device hanging nails therein, larger apertures for receiving an electrical power outlet and receptacle structure, and/or storage box receptacle, as well as the various material holding and supporting apertures and surfaces.

These together with other objects and advantages which will become subsequently apparent reside in the details of construction and operation as more fully hereinafter described and claimed, reference being had to the accompanying drawings forming part hereof, wherein like numerals refer to like parts throughout.

BRIEF DESCRIPTION 0F THE DRAWINGS

DESCRIPTION OF THE PREFERRED EMBODIMENTS

Figures 1, 2:
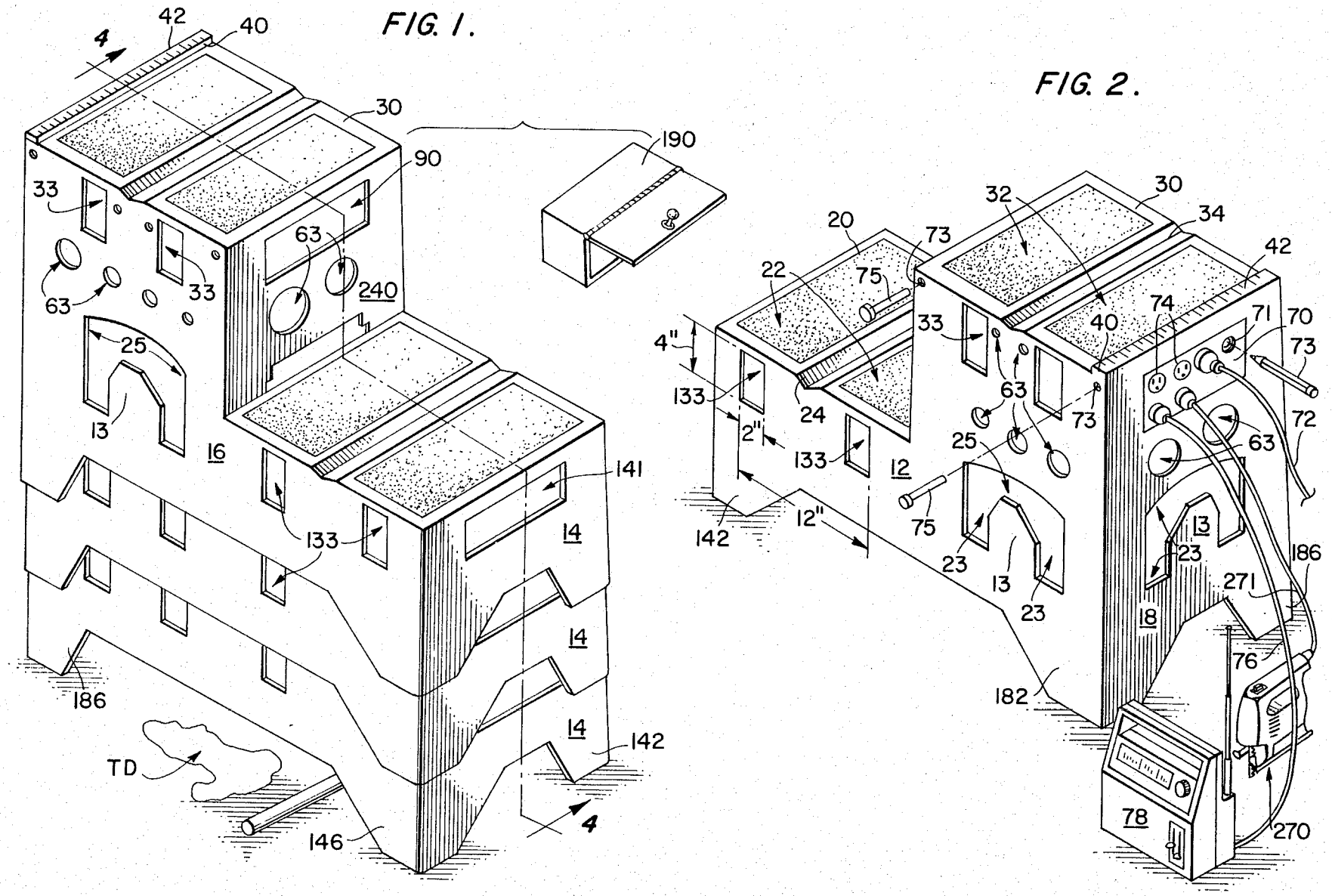
FIG. 1 is a perspective view of a plurality of stacked step stools of the present invention.
FIG. 2 is a perspective view of a single stackable step stool of the present invention as in use for powering an electrical subcomponent.

Referring to FIG. 1 of the drawings, reference numeral 10 indicates in general a plurality of work holding stackable step stools stacked for storage prior to use by a skilled craftsman.

Figure 3:
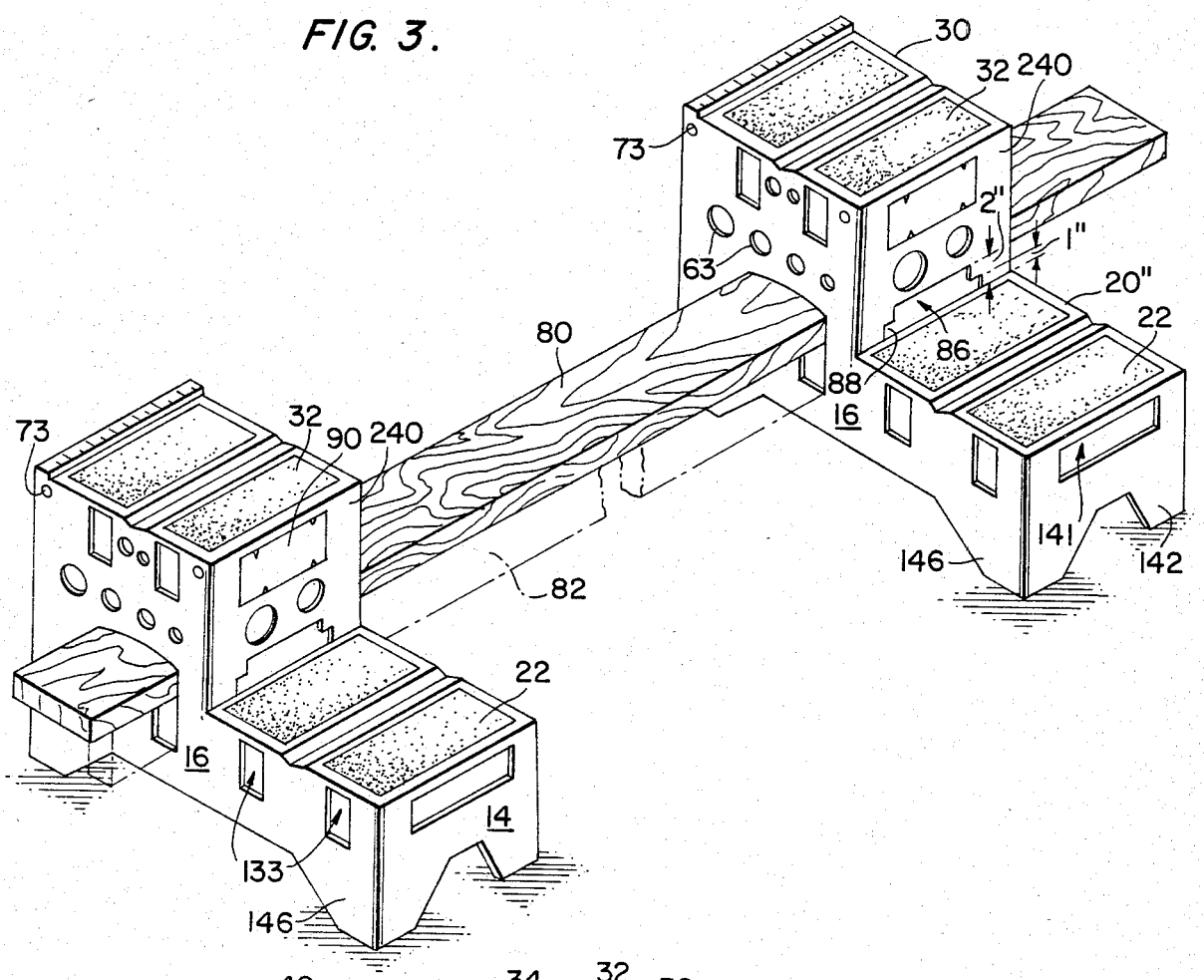
FIG. 3 is a perpective view of two of the stackable step stools of the present invention as being used to provide a low scaffold structure.

FIGS. 2 and 3 show perspective views from opposite sides of the stackable step stool of the present invention as ready for use by a skilled craftsman. The FIG. 5 perspective shows a number of the multi-purpose uses of the stackable step stool of the present invention. While obviously a great number of these uses are shown, in actual practice only one or two of the uses depicted would occur at the same time.

Each step stool has a front end 14, respective step sides 12 and 16 integral with end 14, and a rear end 18 also integral with the respective sides 12 and 16. Preferably, the body structure is molded in one piece, of semi-resilient plastic material, or the like. However, of course, metal or other type materials can be used when desired.

Figure 4:
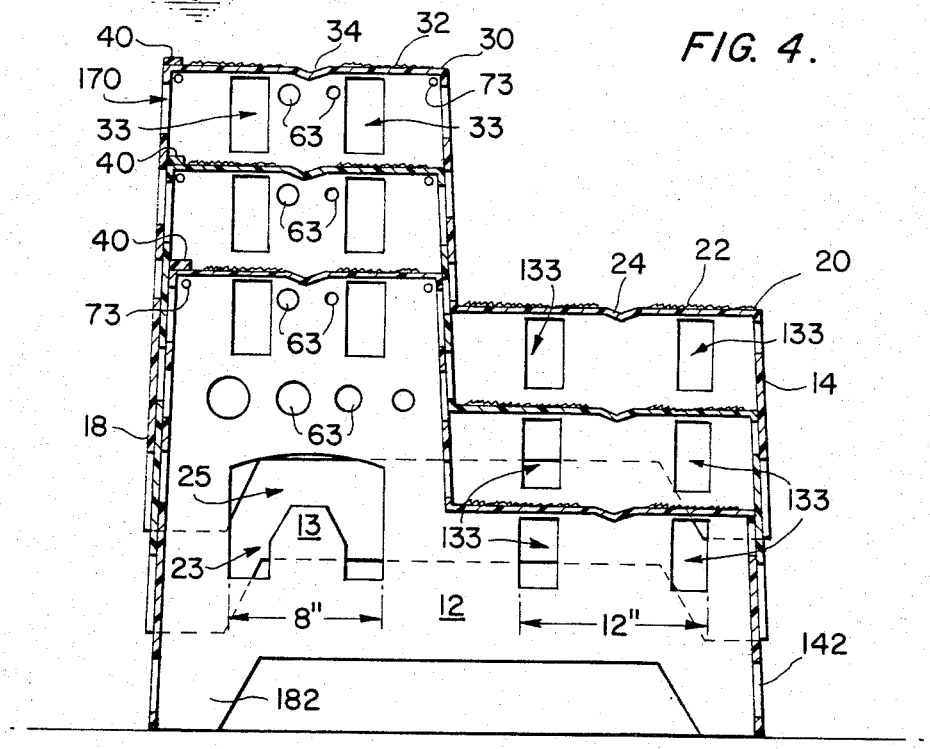
FIG. 4 is a side elevational view of a plurality of stacked step stools, in cross-section, taken generally along lines 4—4 of FIG. 1.

As best seen in FIG. 4, the front and rear ends 14 and 18 respectively have a slight inward and upward taper thereto. Likewise, the sides 12 and 16 have an inward, upward taper thereto. Thus, this tapered configuration of the body permits a plurality of step stools to be conveniently stacked for storage purposes as best shown in the views of FIGS. 1 and 4.

Horizontal steps 20 and 30 also are provided to provide multi-heights for a user of the device. The majority of the upper surface of step 20 is provided with non-skid, high-friction surfacing 22, while upper step 30 is similarly provided with such a surface 32.

Each step is also provided with a traversely extending shallow V-shaped recess, 24 and 34 respectively, for supporting and retaining tubing or piping therein while a craftsman works on same. By the central arrangement of these traverse recesses 24 and 34, a worker can conveniently hold the upper portion of such tubing and/or piping with his foot while sawing, drilling, cutting, bending or otherwise working thereon.

The corners and joining portions between the front 14, the respective sides 12 and 16, and the rear 18 are provided with leg extensions 142, 146, 182 and 186 so that the main body of each step stool will be supported by these leg extensions. Thus, any debris, waste material, wiring cable, pipes and the like on the floor or ground or other surface on which the step stool or stools are placed will not prevent the step stool from being used even though cluttered conditions of the floor surface exist.

The front 14 of each step stool is preferably provided with a handhold 141 for ease in holding and gripping the step stool during movement and positioning thereof. The secondary front 240 for the second step 30 is provided with an opening 86. The total height of this opening is 2" and side recesses 88 of 1" height are also provided. Thus, lumber material of approximately 1" and 2" thickness can be held in this opening and side recesses for supporting the piece of lumber on the first step 20. See the piece of lumber 83 in FIG. 5 of the drawings.

Figure 5:
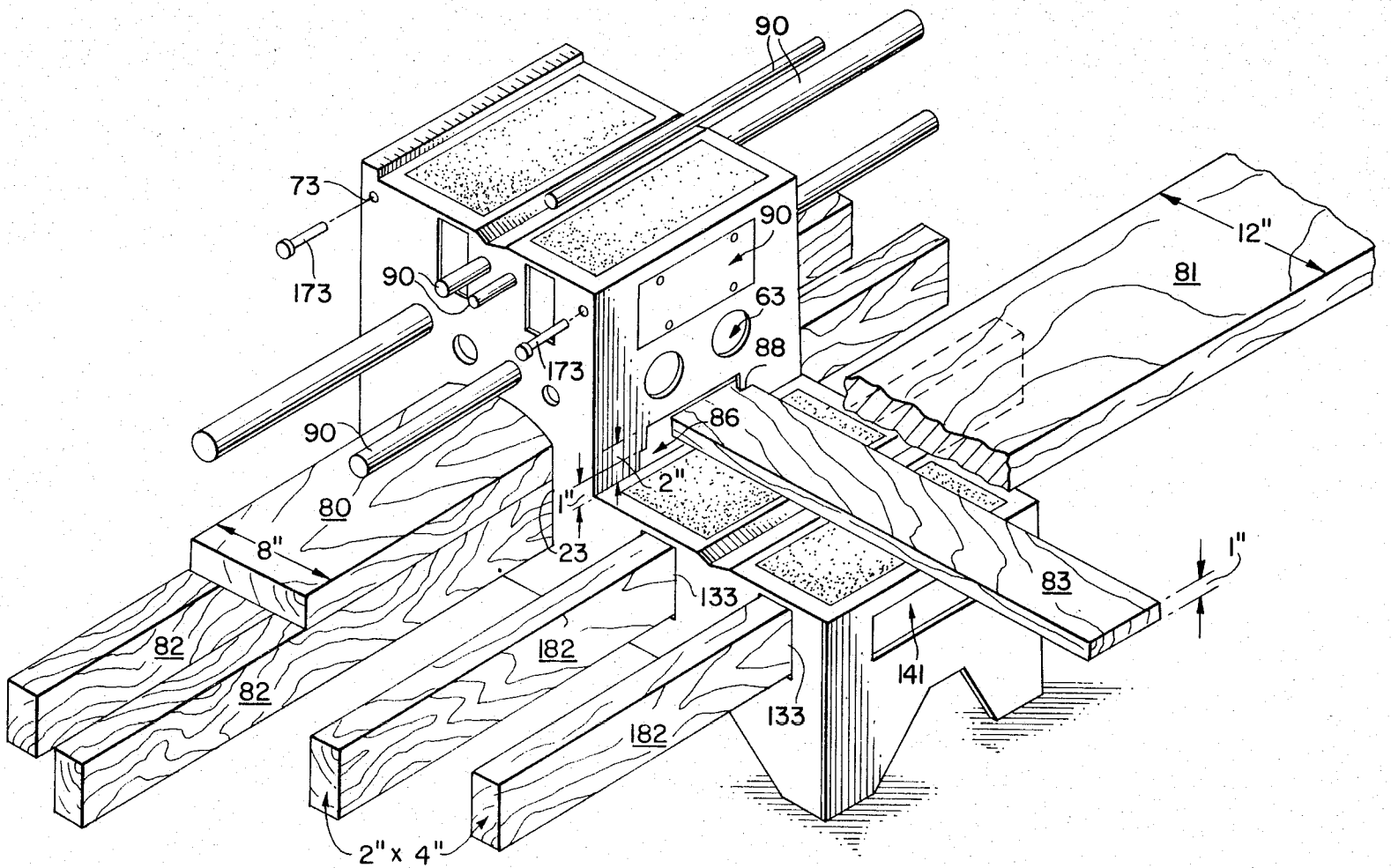
FIG. 5 is a perspective view of a single step stool of the present invention depicting a number of multi-purpose uses of the device.

The respective sides 12 and 16 have corresponding holes and apertures provided therein. Looking at FIGS. 1 and 2 of the drawings, a tongue 13 divides an opening into vertical side portions 23 and a horizontal upper portion 25. A similar opening in the rear end 18 of the body (see FIG. 2) provides similar vertical and horizontal cutout portions. As can best be seen in FIGS. 3 and 5, the vertical cutouts 23 can receive two-by-four lumber 82, while the horizontal cutouts 25 receive a two-by-eight 80 for support by the two-by-fours 82. Thus, when a pair of step stools are used as in FIG. 3, a low scaffolding 80, 82 is provided. Of course, because of the similar cutout arrangement in the rear panel 18, a pair of step stools can be positioned at right angles to the orientation of FIG. 3 and the low scaffolding supported between the respective rear panels of a pair of step stools. Directly above the cutout openings 23 in the lower rear portion of the step stool body are further cutouts 33 which also can receive two-by-four lumber material therethrough. The spacing of the outer edges of these openings is preferably 8" so that a pair of two-by-fours supported in these openings can appropriately support a two-by-eight laid across the upper step 30 of a pair of stools. Thus, a medium height scaffolding arrangement can also be provided for by using these upper apertures 33. Toward the front of each step stool at the respective sides under the first step 20 are provided similar apertures 133 for receiving two-by-four lumber therein. However, the spacing of the outer edges of these openings is preferably 12" so that a low scaffold of two-by-fours supporting a two-by-twelve inch board 81 can be provided for. Thus, another low scaffold arrangement can be arranged by using the appropriate lumber and a pair of the step stools of the present invention. However, in this second low scaffold arrangement, the working room for a user is greater because a two-by-twelve is being securely and firmly supported rather than a two-by-eight. FIG. 5 of the drawings clearly shows the greater width as provided by the two-by-fours 182 in openings 132 for supporting the two-by-twelve 81 as compared to the two-by-fours 82 in the openings 23.

A plurality of holes (openings) 63 are also provided in the respective sides 12 and 16 as well as in the front panel 240. These holes 63 range in size from ½" diameter to 3½" diameter. The purpose of these holes 63 is to hold pipe 90 while the pipe is being worked upon. Because of the spacing between the sides 12 and 16 and their corresponding holes, and the spacing between the front panel 240 and the rear panel 18 and the corresponding holes therein, any pipe which passes through the pair of holes will be very securely held thereby. Thus, for any work operation requiring very secure, positive support and holding of tubing or pipe, the holes 63 will be employed rather than the shallow Vs 24 or 34 in the top of the steps 20 and 30.

Along the upper rear edge of step 30 is provided a lip 40 having inscribed on the upper surface thereof measuring indicia 42. Thus, material to be worked on, whether tubing, pipe, or lumber material, can be placed on the rear portion of upper step 30 against the lip 40 and appropriate measurement indications made on the material to be worked on using the indicia 42.

Another feature of the present invention is the provision of a rear aperture 170 for reception of a multiple receptacle power outlet 70. A connector cord 72 can be plugged into conventional household or commercial power mains and the plurality of receptacle sockets 74 can be used for plugging in tool implements such as a saw 270 with power cord 271, a portable drill (not shown), a radio 78 having a power cord 76, or similar type electrical tools and appliances, such as a drop light, if needed. Also, as part of the power receptacle unit 70, an electric pencil sharpener 71 may be included. Such a sharpener can be very useful and handy for keeping a carpenter's pencil 73 in good usable form with a sharp point thereon.

Also on the secondary front panel 240 an aperture 90 may be provided for holding a storage box with lid 190. Such a storage box can be used for various other tools and equipment of a skilled craftsman.

Small holes 73 may also be provided at each of the upper end corners of the step stool for reception of a common nail 75 therein for the purpose of hanging the step stool in a garage, workshop or the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A device for use by a skilled craftsman comprising:
a formed body of non-corrosive plastic material;
said body configured to provide two planar step surfaces at different heights and two equal sides and two equal ends each having leg extensions for raising the body above a support surface, said two sides and two ends being substantially parallel and with a slight inward and upward taper so that a plurality of the devices can be stacked for storage purposes;
means with at least one of said two planar step surfaces for holding tubular material such as pipe to be worked on; and
further means provided in said sides for holding boards therewith.

2. The device set forth in claim 1, further including additional means for holding pipe through at least two opposite sides of said formed body.

3. The device set forth in claim 2, wherein the uppermost planar step surface is provided along one edge with a scale having units of measurement thereon.

4. The device set forth in claim 3, wherein said scale with units of measurement is mounted on a lip for the purpose of holding material to be cut from sliding off the planar step surface.

5. The device set forth in claim 4, together with at least two holes in at least one side for receiving a common nail in each for the purpose of hanging the device during storage thereof.

6. The device set forth in claim 5, together with an electrical panel mounted in an aperture in a side of the formed body, and further including a main power supply adaptor unit attached to said electrical panel.

7. The device set forth in claim 6, further including a pencil sharpener as part of said electrical panel for use by carpenters in maintaining their carpenter pencils in usable condition.

8. The device set forth in claim 5, wherein an aperture in said formed body holds a storage box during use of said device.

9. The device set forth in claim 2, wherein a lip is provided along one edge of at least one of said planar step surfaces, said lip being provided with units of measurement therealong for convenience of measuring stock to be worked on.

10. The device set forth in claim 2, together with at least two holes in at least one side for receiving a common nail in each for the purpose of hanging the device during storage thereof.

11. The device set forth in claim 2, together with an electrical panel mounted in an aperture in a side of said formed body, and further including a main power supply adaptor unit attached to said electrical panel.

12. The device set forth in claim 2, wherein an aperture in said formed body holds a storage box during use of said device.

13. A multi-purpose support device comprising:
a rectangular body having four sides;
said rectangular body provided with two planar support surfaces at different heights;
each of said sides having a slight taper in the vertical direction so that a plurality of said devices can be stacked one upon another and thereby take up as little storage space as possible;
a plurality of aperture means provided in each of said four body sides for securely retaining a piece of material on which work is to be performed; and
holding means with each of said two planar support surfaces for receiving tube-like material to be worked upon.

14. The device set forth in claim 13, wherein said plurality of aperture means in said body sides include both round and rectangular openings for holding pipe and lumber material, respectively.

15. The device set forth in claim 14, wherein said round openings comprise a plurality of holes having a diameter of ½" to 3½" in graduated sizes for receiving pipe of corresponding sizes.

16. The device set forth in claim 14, wherein said rectangular openings comprise a plurality of vertical apertures as well as horizontal apertures for receiving various sizes of lumber material therein.

17. The device set forth in claim 16, wherein said round openings comprise a plurality of holes having a diameter of ½" to 3½" in graduated sizes for receiving pipe of corresponding sizes, and said device further including at least one handhold and a plurality of small openings for hanging said device from a support nail.

18. The device set forth in claim 14, wherein said holding means with each of said two planar support surfaces includes a relatively shallow V-shaped groove in the top of each support surface.

19. The device set forth in claim 14, wherein said rectangular body having four sides further includes each corner side joint connecting the respective sides having a leg extension for supporting the body at a level substantially above the bottom of each leg.

20. The device set forth in claim 14, together with a lip having indicia thereon provided along one edge of the highest planar support surface.

21. The device set forth in claim 14, together with an electrical power outlet panel including pencil sharpening means mounted in another aperture provided in said device.

* * * * *